US005716292A

United States Patent [19]

Huang

[11] Patent Number: 5,716,292

[45] Date of Patent: Feb. 10, 1998

[54] GOLF CLUB HEAD

[76] Inventor: Hui Ming Huang, No. 528, Yow Chang Street, Kaohsiung, Taiwan

[21] Appl. No.: 686,155

[22] Filed: Jul. 24, 1996

[51] Int. Cl.[6] ..... A63F 53/04

[52] U.S. Cl. ..... 473/349; 473/335; 473/345

[58] Field of Search ..... 473/324, 334, 473/335, 345, 346, 349, 350

[56] References Cited

U.S. PATENT DOCUMENTS

| | | | |
|---|---|---|---|
| 4,121,832 | 10/1978 | Ebbing | 473/335 |
| 5,482,282 | 1/1996 | Willis | 473/324 |
| 5,533,729 | 7/1996 | Leu | 473/346 |
| 5,570,886 | 11/1996 | Rigal et al. | 473/335 |

*Primary Examiner*—William M. Pierce
*Attorney, Agent, or Firm*—David & Raymond; Raymond Y. Chan

[57] ABSTRACT

An improved golf club head includes a striking piece, a balance weight and a head body. The striking piece is made of titanium alloy by pressing and has a hitting plate and a connection portion integrally connected to the hitting plate for connecting with a golf shank. A bottom periphery of the hitting plate provides a toe portion extended outwardly. On a bottom surface of the hitting plate further affixes two nuts at two side locations thereof. The balance weight has a middle and two side protruding ribs extending upwardly according to the shape of the head body, in which each of the two side protruding ribs has a counter screw hole for receiving the two nuts and connecting with the hitting plate of the striking piece by screwing two screws through the two counter screw holes and the two nuts respectively. The head body has a hollow chamber for receiving the balance weight and is made of the same material as the striking piece. The head body also has an opening. When the striking piece is inlay into the head body, the opening and the toe portion of the hitting plate would line up, so that the hitting plate of the striking piece is capable of welding to the head body along the toe portion. Thus, the quality of the golf club head can be enhanced and the disadvantage of the conventional golf club can be improved.

4 Claims, 4 Drawing Sheets

GOLF CLUB HEAD

BACKGROUND OF THE INVENTION

The present invention relates to a golf club head, and more particularly to an improved iron golf club head which can firmly affix a striking piece to a head body of the golf club head so as to eliminate the chance of looseness and break apart of the striking piece from the head body.

The well known technology for the construction of an iron golf club head has the following conventional methods:

1. Construct the whole golf club head with iron by forging, which contains economical disadvantages of high manufacturing cost and low performance that may lessen the competitive ability of the manufacturer in the market.
2. Another way to construct an iron golf club head is by casting. A head body is cast by iron, which surface is further finished by mechanical treatment. In order to increase the rigidity and impacting strength of the striking surface, a striking piece made of titanium alloy is affixed to the head body. However, such combination still exists difficulty and unsolved shortcomings as follows.

According to the present known technology, there is no way to firmly weld two different metal materials together yet. Thus, such titanium-iron golf club head is constructed merely by screwing the titanium alloy striking piece onto the iron head body. It is well known that screwing construction is very difficult to maintain a firm and tight connection for long time. Therefore, such screwing striking piece tends to loosen off or even fall apart from the head body after a certain period of usage.

SUMMARY OF THE INVENTION

The main objective of the present invention is to provide an improved iron golf club head wherein a striking piece is able to firmly and tightly affix on a head body of the golf club head in order to eliminate the chance of looseness and falling apart of the striking piece from the head body.

Another objective of the present invention is to provide an improved iron golf club head which has a easily manufactured construction and a low manufacturing cost.

Accordingly, an improved golf club head of the present invention comprises a striking piece, a balance weight and a head body. The striking piece is made of titanium alloy by pressing and has a hitting plate and a connection portion integrally connected to the hitting plate for connecting with a golf shank, in which the hitting plate has a front hitting surface which has a plurality of scoring lines formed thereon. A bottom periphery of the hitting plate provides a toe portion extended outwardly. On a bottom surface of the hitting plate further affixes two nuts at two side locations thereof. The balance weight has a middle and two side protruding ribs extending upwardly according to the shape of the head body, in which each of the two side protruding ribs has a counter screw hole for receiving the two nuts and connecting with the hitting plate of the striking piece by screwing two screws through the two counter screw holes and the two nuts respectively. The head body has a hollow chamber for receiving the balance weight and is made of the same material as the striking piece. The head body also has an opening that has a same periphery shape as the bottom toe portion of the hitting plate of the striking piece. When the striking piece is inlay into the head body, the opening and the toe portion of the hitting plate would line up, so that the hitting plate of the striking piece is capable of welding to the head body along the toe portion. Thus, the quality of the golf club head can be enhanced and the disadvantage of the conventional golf club can be improved.

A modification of the present invention also provides an improved golf club head which comprises a head body and a striking piece. The striking piece is made of titanium alloy and has a balance weight provided integrally at a back surface of the striking piece. The head body is made of aluminum alloy and has a receiving chamber for receiving the balance weight. The striking piece is manufactured by pressing and is connected with the head body by means of burnt out (dewaxing cast) method to receive the balance weight of the striking piece to form the golf club head which has the advantages of decreasing the cost of production and improving the manufacturing quality.

DETAILED DESCRIPTION OF THE PREFERRED EMBODIMENT

Referring to FIG. 1 through FIG. 10 of the drawings, an improved golf club head according to a first preferred embodiment of the present invention comprises a striking piece 10, a balance weight 20 and a head body 30.

Figure 1:
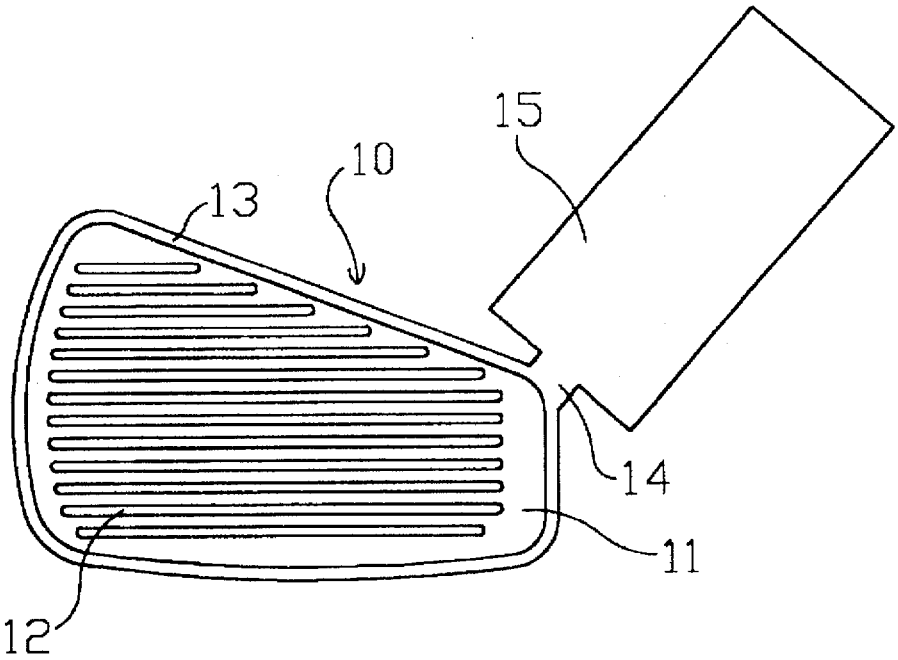
FIG. 1 is a front view of a semi-finishing striking piece according to a preferred embodiment of the present invention.
Figure 2:
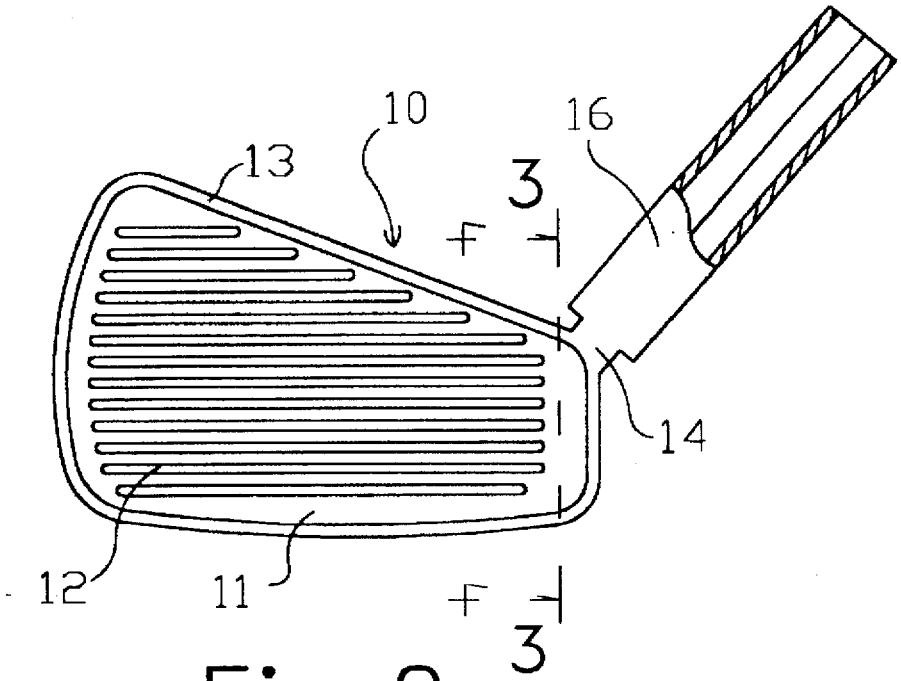
FIG. 2 is a front view of the finished striking piece according to the above preferred embodiment of the present invention.
Figure 3:
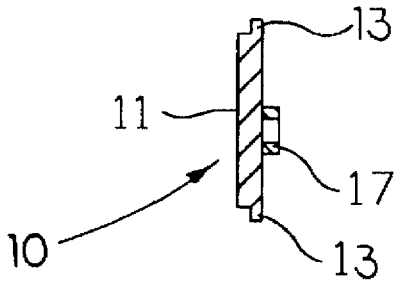
FIG. 3 is a sectional end view of line 3—3 of FIG. 2.

The striking piece 10 is made of titanium alloy by pressing, which comprises a hitting plate 11 and a rod like connection portion 16 integrally connected to the hitting plate for connecting with a golf shank of a golf club. The hitting plate 11 has a front hitting surface which forms a plurality of scoring lines 12 thereon. A bottom periphery of the hitting plate 11 has a toe portion 13 extended outwardly. After pressing treatment, the striking piece 10 is in a flat plate form as shown in FIG. 1. At this stage, a flat portion 15 is connected to the hitting plate 11 through a neck portion 14. Then, the flat portion 15 is rolled up to form the connection portion 16 which is in cylindrical form (as shown in FIG. 2). In addition, two nuts 17 are welded on two side locations of a bottom surface of the hitting plate 11 (as shown in FIG. 3).

Figure 5:
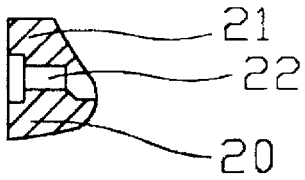
FIG. 5 is a sectional end view of line 5—5 of FIG. 4
Figure 4:
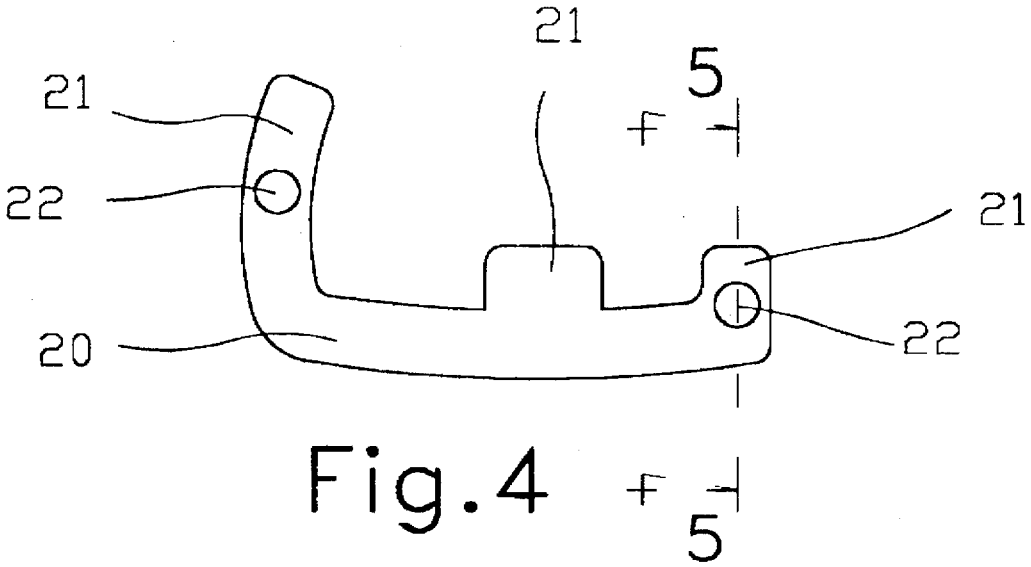
FIG. 4 is a front view of a balance weight according the above preferred embodiment of the present invention.
Figure 6:
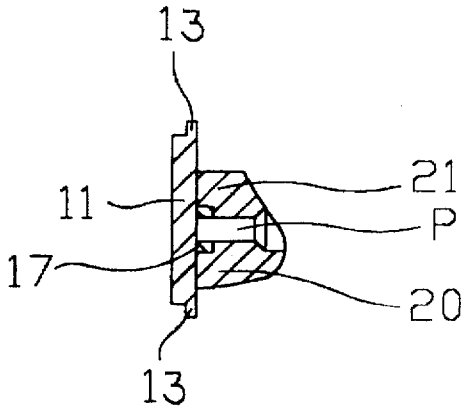
FIG. 6 is a sectional view illustrating the connection between the striking piece and the balance weight according to the above preferred embodiment of the present invention.

As shown in FIG. 4 and FIG. 5, the balance weight 20 has a middle and two side protruding ribs 21 extending upwardly according to the shape of the head body 30. Each of the two side protruding ribs 21 has a counter tapped hole 22 for receiving the two nuts 17 and connecting with the hitting plate 11 of the striking piece 10 by screwing two screws P through the two counter screw holes 22 and the two nuts 17 respectively (as shown in FIG. 6). In the other words, the balance weight 20 is affixed on the two nuts 17 attached to bottom surface of the hitting plate 11 by passing the two screws P through the two counter tapped holes 22 of the two side protruding ribs 21.

Figure 8:
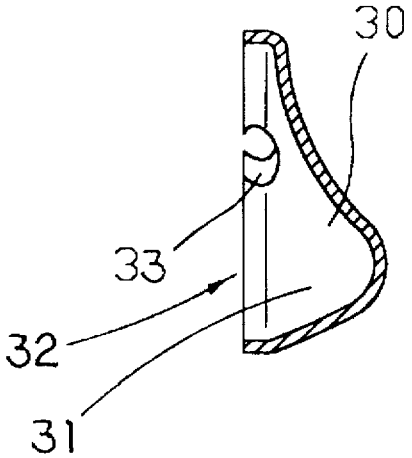
FIG. 8 is a sectional end view of line 8—8 of FIG. 7.
Figure 7:
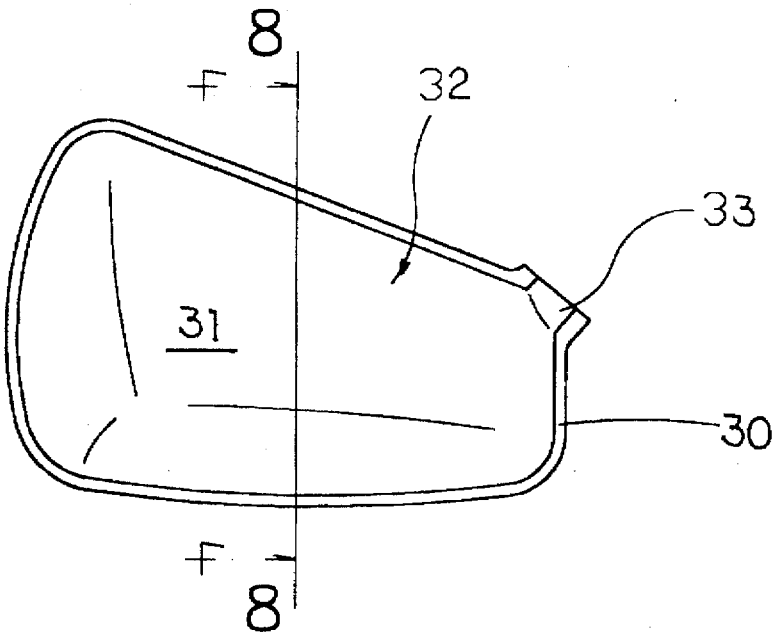
FIG. 7 is a front view of a head body according to the above preferred embodiment of the present invention.

As shown in FIG. 7 and FIG. 8, the head body 30 is a hollow body having a hollow chamber 31 for receiving the balance weight 20 and is made of the same materials as the striking piece 10, i.e. titanium alloy. The hollow chamber 31 of the head body 30 has an opening 32 that has same periphery shape of the toe portion 13 of the hitting plate 11 of the striking piece 10. At one side of the head body 30 further provides a curly neck 33 for guiding the connection portion 16 of the striking piece 10 in position.

Figure 9:
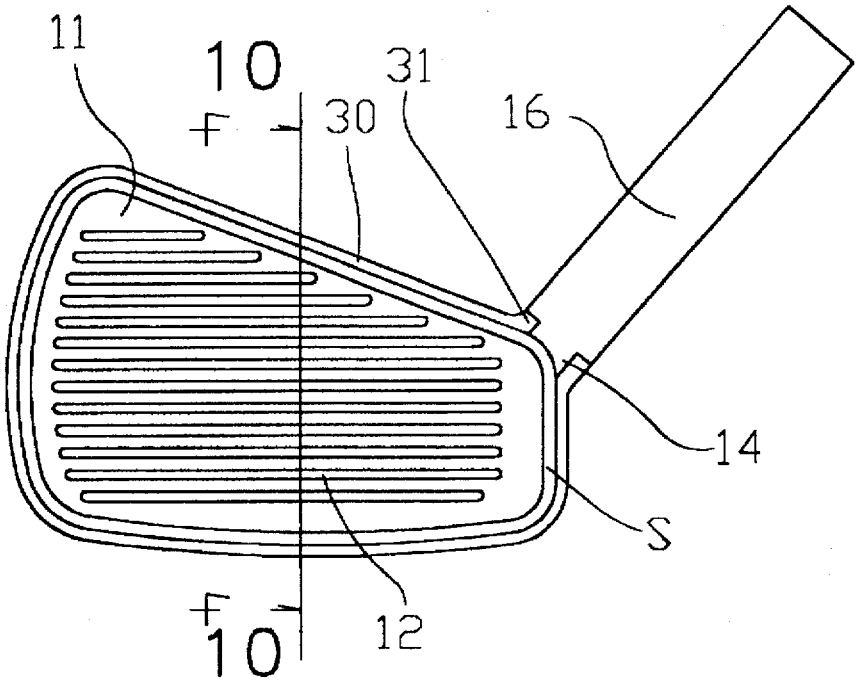
FIG. 9 is a front view of the improved golf club head according to the above preferred embodiment of the present invention.
Figure 10:
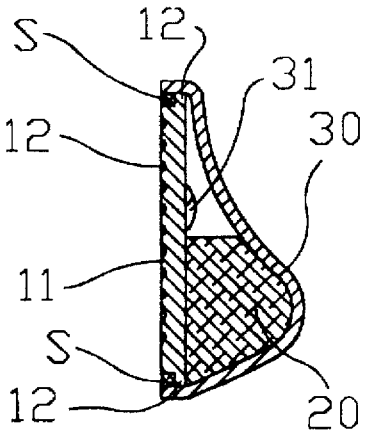
FIG. 10 is a sectional end view of line 10—10 of FIG. 9.

Accordingly, when the striking piece 10 is inlaid into the hollow chamber 31 head body 30, the opening 32 and the toe portion 13 of the hitting plate 11 would line up. The curly portion 33 of the head body 30 is engaged with the neck portion 14 of the striking piece 10 for guiding the striking piece 10 in position. Therefore, the hitting plate 11 of the striking piece 10 is capable of welding with the periphery edge side of the head body 30 along the toe portion 13 so as to firmly and tightly affixed the striking piece 10 with the head body 30 to form the integral golf club head (as shown in FIG. 9 and FIG. 10, reference S representing the welding material).

In accordance with the above disclosure of the present invention, the benefit and the projecting improvement are as follow:

1. The construction of the present invention is simple and easy. Moreover, the connection of the striking plate 10 with the head body 30 is firm and tight so that the quality of the golf club head can thus be enhanced.

2. Because the material for constructing the striking piece 10 and the head body 30 is the same, there is no difficulty during welding and the welding connection between the same materials is very tough, so that the chance of loosening or falling apart would not exist.

3. The striking piece 10 and the head body 30 of the present invention are both constructed by pressing that, it not only completely solves the problem (such as bubble high expense for production, low efficiency of process, etc.) of forging and casting, but also can very effectively lower the cost of production and improve the manufacturing quality.

Figure 11:
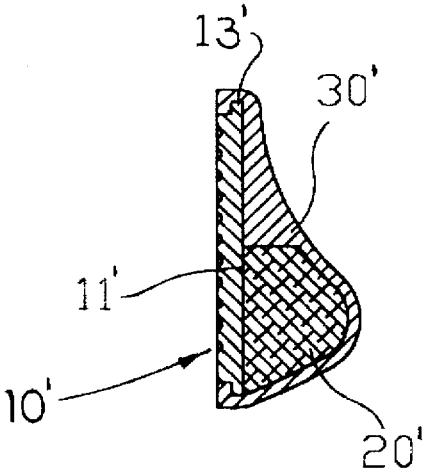
FIG. 11 is a sectional end view of a second preferred embodiment of the present invention.

Referring to FIG. 11, a modification of the present invention is illustrated as a second preferred embodiment. The striking piece 10' is made of titanium alloy and has a balance weight 20' affixed integrally at a back surface of the hitting plate 11' of the striking piece 10'. The head body 30' of the present invention is made of aluminum alloy and constructed by use burnt out method so as to integrally embed the balance weight therein and engage the toe portion 13' of the hitting plate 11' of the striking piece 10' to form a solid golf club head. Such construction has the following benefit:

1. Because it's constructed by burnt out method, there is no difficulty of connection, moreover the connection results a very tough structure that the chance of loosening or falling apart would not exist.

2. The head body 30' can also be made of plastic by injection to form a one piece solid golf club head.

I claim:

1. An improved golf club head, comprising:

a striking piece, which is made of titanium alloy by pressing, comprising a hitting plate and a connection portion integrally connected to said hitting plate for connecting with a golf shank, wherein said hitting plate has a front hitting surface which has a plurality of scoring lines formed thereon, a toe portion extended outwardly from a bottom periphery of said hitting plate, and two nuts affixed at two side locations on a bottom surface of said hitting plate;

a balance weight having a middle and two side protruding ribs extending upwardly according to a shape of said head body, said two side protruding ribs respectively having two counter screw holes to receive said two nuts respectively, so as to connect said balance weight with said hitting plate of said striking piece by screwing two screws through said two counter screw holes and said two nuts respectively; and a head body, which is made of titanium alloy, having a hollow chamber to receive said balance weight, wherein said hollow chamber of said head body has an opening that has a same periphery shape as said toe portion of said hitting plate of said striking piece, said striking piece being inlaid into said hollow chamber of said head body until said opening and said toe portion of said hitting plate lining up, said hitting plate of said striking piece being welded to a periphery edge side of said head body along said toe portion, so as to firmly and tightly affixed said striking piece with said head body to form said golf club head.

2. An improved golf club head as recited in claim 1 wherein said connection portion is in a cylindrical form.

3. An improved golf club head as recited in claim 1 wherein said two nuts are welded on said bottom surface of said hitting plate.

4. An improved golf club head as recited in claim 1 wherein said striking piece further has a neck portion formed between said hitting plate and said connection portion, and that said head body further has a curly neck formed at one side thereof to engage with said neck portion of said striking piece for guiding said connection portion of said striking piece in position.

* * * * *